United States Patent [19]

Pedrini

[11] 4,223,418

[45] Sep. 23, 1980

[54] DEVICE FOR QUICKLY WASHING KITCHENWARE, GLASSES, POTS AND THE LIKE

[76] Inventor: Ivano Pedrini, Via dei Mille,, 22-S. Giuliano Milanese (Milanese), Italy

[21] Appl. No.: 6,559

[22] Filed: Jan. 25, 1979

[30] Foreign Application Priority Data

May 24, 1978 [IT] Italy ..... 21931/78[U]

[51] Int. Cl.[3] ..... A46B 13/02

[52] U.S. Cl. ..... 15/28

[58] Field of Search ..... 15/22 R, 23, 24, 28, 15/, 29, 93 R, 97 R; 51/170 PT, 170 T, 170 TL; 132/59

[56] References Cited

U.S. PATENT DOCUMENTS

| | | | |
|---|---|---|---|
| 1,550,187 | 8/1925 | Vara | 15/24 |
| 1,555,522 | 9/1925 | Shapiro | 15/23 |
| 1,620,591 | 3/1927 | Braly | 75/24 X |
| 2,904,804 | 9/1959 | Odessey | 15/23 X |
| 2,944,271 | 7/1960 | Foster et al. | 15/28 |
| 3,023,437 | 3/1962 | Dresen | 15/23 |
| 3,312,994 | 4/1967 | Fassio | 15/28 X |

FOREIGN PATENT DOCUMENTS

| | | | |
|---|---|---|---|
| 1171852 | 10/1958 | France | 15/28 |

*Primary Examiner*—Edward L. Roberts
*Attorney, Agent, or Firm*—Bucknam and Archer

[57] ABSTRACT

A device for quickly cleaning, de-scaling, washing and polishing kitchenware, glasses and in particular pots, for home, restaurants and other use, is described which comprises a brushing tool, in particular a rotating brush, associated to a handle and to a source of energy. The tool may be shifted in different positions and orientations effective to provide an efficient cleaning action on the article to be cleaned. This is accomplished by means of a flexible driving system and a motor which is swingably supported.

2 Claims, 7 Drawing Figures

10
12
12
20
28a
B 28b
44
C
16
42
14
M
38
40
A
B 32
36
34
30
28
14
16
28a
A
B

Fig. 5
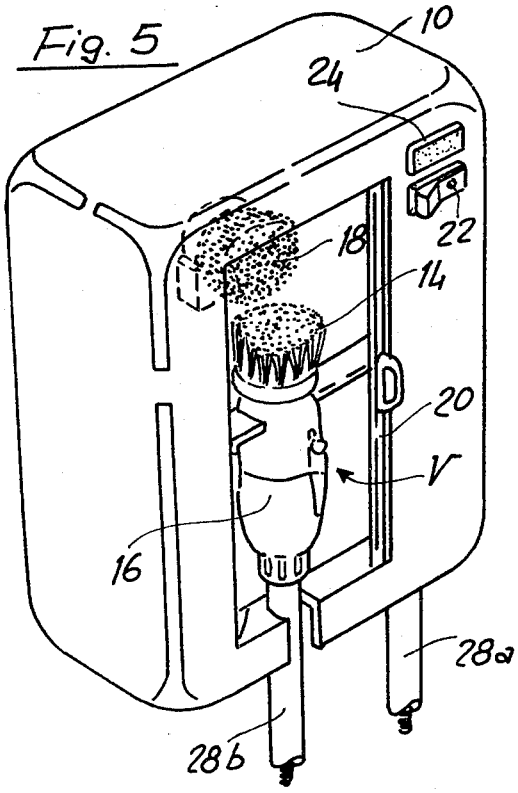
Fig. 4
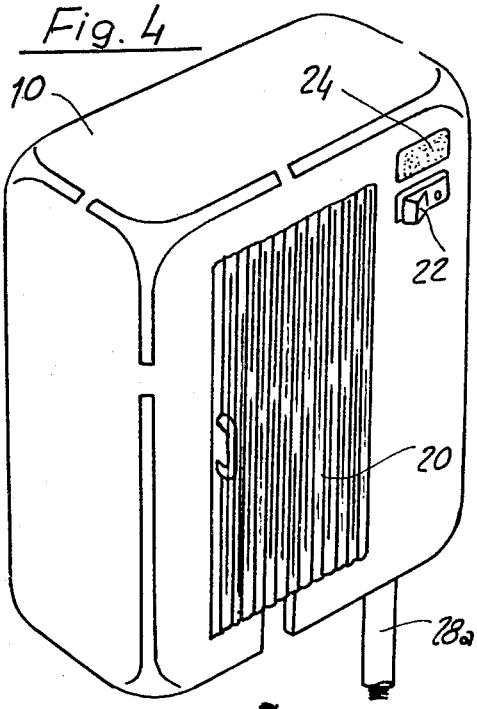
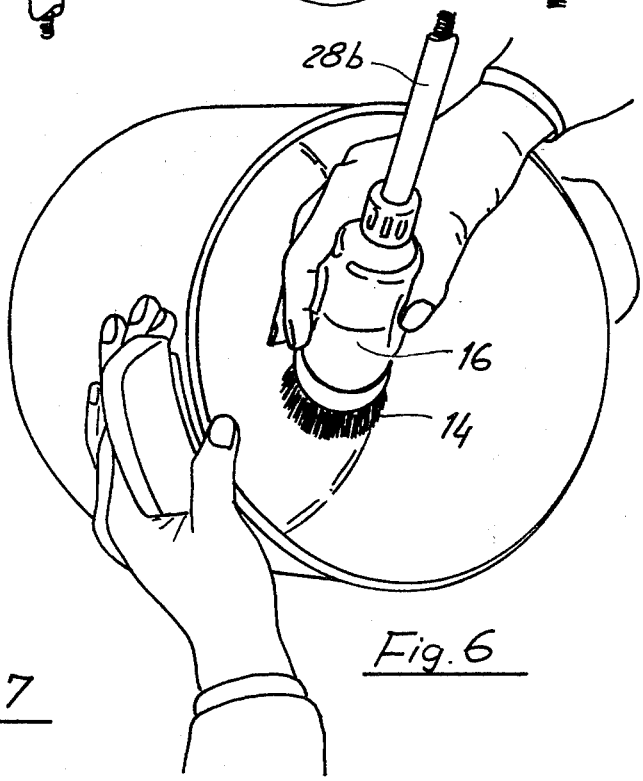
Fig. 6
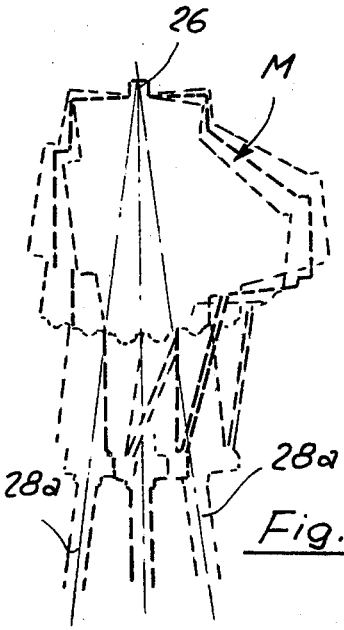
Fig. 7

DEVICE FOR QUICKLY WASHING KITCHENWARE, GLASSES, POTS AND THE LIKE

The present invention relates to a device effective to quickly, rationally and efficiently carry out the removal of dirt, grease, scale and the like from table and/or kitchen articles, such as plates and other kitchenware, glasses, and pots, casseroles, pans or the like, after use. In particular, the device according to the present invention is effective to carry out in a quick manner, those operations which may be defined as "pre-washing" operations of said articles by mechanical means without the operator getting tired, preliminarily to the proper washing, sterilization operations and the like which are carried out, preferably but not necessarily in kitchenware washing machines.

The device according to the present invention may be advantageously used both in the home as well as "industrial or professional" establishments, in restaurants, hotels, and other community buildings, in which a great amount of table and/or kitchen articles are handled.

In fact it is known that the "washing-up" operation of plates and kitchenware in general, if rationally carried out, may not be exclusively carried out by the kitchenware-washing machines (where available) both due to the machine efficiency reasons because machine operations exclusively exploit the action of water jets, in association with cleaning agents and reasons of time and energy consumption. In fact, an effectively complete and rational washing should be preceded by a pre-washing step, in water, preferably with soap, associated with a rubbing operation. This pre-washing step, requires at present manual actions, also, in particular in the case of glasses, auxiliary mechanisms including rotating brushes about which the glass is operated upon have been used. However, these operations are tiring and/or difficult, and require continuous and prolonged water immersions of the hands, and the like.

Particularly difficult and tiring are specifically the kitchenware pre-washing operations because on the surfaces of the kitchenware unavoidably greases, commestible substance residues, scales, and other materials are present and their removal requires a tiring rubbing operation.

In the light of the foregoing, it is an object of the present invention to provide a device effective to eliminate at least a great part of the mentioned wellknown drawbacks, mentioned hereinabove, which device comprises rotating brushing means, associated to a handle by which the rotating brushing means may be presented and manually pressed onto the surfaces and parts to be cleaned in a variety of ways, preferably in the presence of water and soap, and mechanically coupled to a motor, in particular of the electrical type, imparting to the brushing means the required rotation movement, possibly reduced by gear means.

Accordingly, the energy actually used in the rubbing action is provided by the electrical motor, and manual action is required exclusively for the task of selectively and variably locating the brushing means in contact with the surfaces and parts to be cleaned.

According to an advantageous useful embodiment of the device of this invention, which obviously has to operate in the presence of water and the handle of which may be gripped by the operator, the electrical motor is located and supported at a distance from the brushing means, and the means to actuate the brushing means in particular the switching on and off of the motor exclude the parts and components which may contact the operator hands and are subjected to potential differences.

Specifically, the device according to the invention comprises, in combination, an essentially immobile supporting-holding or containing member, effective to be located at a distance from the area, in particular the wash-basin, in which the operation is carried out, and in which the motor is installed and protected, a rotating brush, associated, preferably in an easily replaceable manner, to a handle in which is rotatively mounted the brush shaft, and a flexible driving mechanism coupling said motor and brush, effective to impart to the latter the rotation movement, thereby allowing for the operator to variably orient and shift the handle, and accordingly the brush, through a broad position range.

Advantageously, the flexible driving mechanism does not comprise metal components susceptible to the application of dangerous potential differences. Furthermore, the flexible driving mechanism may be used for driving remotely a switch 40 located in the supporting-holding member for switching on and off said motor.

The aforesaid and other more specific constructional and operative characteristics of the device according to the invention, and suitable for imparting thereto further useful effects, in particular ease of service and efficiency, will become more apparent from the following detailed description of an exemplificative embodiment of the device, reference being made to the accompanying drawings, where:

FIGS. 4 and 5 illustrate in perspective the supporting-holding member in closed and open conditions for housing the operating components;

FIG. 6 illustrates in perspective the possibility of use of the device, for the preliminary pre-washing or cleaning for example of a casserole, and FIG. 7 schematically illustrates a useful motor mounting arrangement effective to enhance, by facilitating the movements and orientations thereof, the handling range of the rotating brush.

Figures 1, 2, 3:
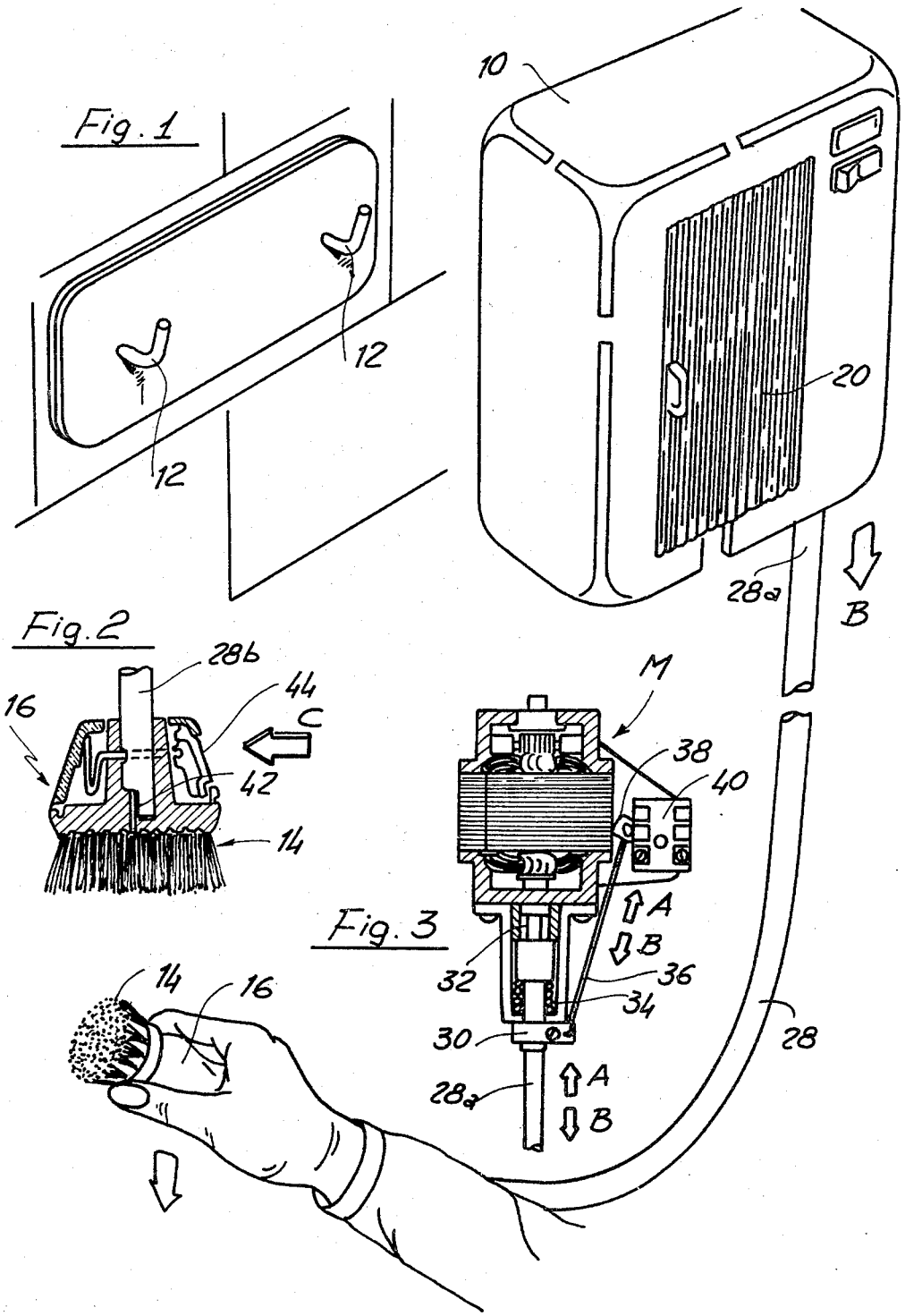
FIG. 1 illustrates in perspective in a simplified manner, the complete combination of the main components of the device.
FIG. 2 is a cross-section illustrating a non limitative exemplary embodiment of a replaceable means for the coupling of the rotating brush to the flexible driving mechanism or system.
FIG. 3 illustrates, also in a cross-section, an exemplary embodiment of the motor means, as associated to a switch effective to be remotely controlled through the same flexible driving system by the operator using the device by this invention.

Referring particularly to the drawing figures; in the non limitative embodiment illustrated in FIGS. 1, 4, 5 and 6, the device comprises a static portion, preferably formed by a small piece of furniture (10) which may be installed in the most suitable position, preferably hanging on a wall, for example by means of hook elements (12) (FIG. 1) above and near the wash-basin. In order to facilitate the service, the small furniture piece (10) may be hooked to the wall (possibly under the suspended furniture pieces at present used in modern kitchens) by means of a horizontal rail system, along which said furniture piece may be moved to the right or to the left, in order to remove the furniture piece when the device is not used, and/or to modify, during the service, the location or position thereof, as necessary.

The furniture piece (10) forms the protecting housing or case for the electrical motor and, in a portion, as it is shown in FIG. 5, a housing for the rotating brush (14) and the handle (16). In the same space may be housed another rotating brush (18) or several additional rotating brushes effective to be used in a replaceable manner. For example, the device may comprise a brush set, the brushes being provided with different hardness bristles. They may be synthetic and/or natural vegetal or animal occurring fibres, to be selectively adopted depending on the needs.

The space V (FIG. 5) for housing the operative assembly (14), (16) and/or other fittings, may be advantageously closed by a shutter or port (20) for example of the wind type, or the like. On the outside of the furniture piece or box (10) may be located a main switch (22) and a signalling lamp (24), effective to signal that the device is connected to the energy source.

Also the electrical motor is located in said box, preferably in the described hereinbelow manner. The motor, generally indicated by M in FIGS. 3 and 7, is advantageously supported, in the furniture piece or box, in such a way as to be swingable for example about a horizontal axis indicated by (26) in FIG. 7, or provided with a cardan joint, in order to afford a sufficient swinging mobility to cause the starting portion (28*a*) of the flexible driving system (28) illustrated in great part in FIG. 1 to match or adapt itself to position and orienting shifts, even of a comparatively high value, of the handle (16) which is gripped and operated by the operator. In FIGS. 3 and 6 have been illustrated, only as an example, different various service conditions, for example for accurately cleaning, by rubbing, the interior of a kitchen article or tool, as represented in FIG. 6, the handling of the cleaning tool obviously requiring realignment which may be substantial between the starting portion or length (28*a*) and the end portion (28*b*) of the flexible driving system (28), which, in addition, may be obliged to assume a remarkably curved pattern.

No current goes through the flexible driving system (28) which is realized and connected in a known way to the driving-device and driven components and the driving mechanism may be used, according to an advantageous non exclusive characteristic of the invention, as a driving member for a secondary switching system 40 downstream located from the main switch (22). To this end, the starting portion (28*a*) of the flexible driving system is connected, as illustrated in FIG. 3, to a collar (30) effective to be moved in the two directions A and B (FIG. 3) with respect to the motor M, the rotation transmitting coupling being assured by a sleeve and slotted shaft assembly (32) or the like. The flexible shaft is recovered in the A direction, for example by a spring (34) and the collar (30) is connected, for example by means of a small rod (36), to the movable member (38) driving the secondary switch, for example a microswitch (40). The flexible driving mechanism drives the switch 40 through an electroinsulating element.

Accordingly, by applying a temporary pulling force in the B direction to said flexible driving system (28) it is possible to exercise a driving action which causes activation of the motor M and then activate the brush (14) to rotate for the service. The reverse action causes the motor to stop, while the electrical current does not reach the hand of the operator.

Obviously the motor may be activated by other means, for example by supplying, by means of a push-button member or the like, as associated to the handle (16), a fluid pressure to the switch. It is also possible to apply a very low voltage and amplitude electrical signal, effective to be amplified, in the interior of the furniture piece or box (20).

As mentioned hereinabove, the brush (14) (or 18 FIG. 5) may be replaceably connected to the output end (28*b*) of the flexible driving system, for example by means of a male-female plug member (42) (or the like) effective to be released for example by pushing in the C direction a push-button (44) associated to the end of the handle (16) (only partially represented in FIG. 2).

The useful results of the device of this invention and the concepts thereof as deducible from the above description, are self-evident.

The kitchenware, or the like, may be quickly and rationally pre-washed with a substantially reduced labour. The kitchenware or other articles to be washed, are preferably preliminarly immersed in a wash-basin, possibly with soapy water, and the operation may be carried out under water. Upon removing the tool (14), (16), located in the box (10) (FIG. 5), the tool may be easily handled and activated, for example by imposing a traction in the B direction on the flexible driving system (28), and then it may be oriented and placed in the most suitable manner (the handle shown in FIG. 6 being only one of the great number of the possible handle conditions) in order to remove, quickly and easily, all of the traces substances on the article to be pre-washed, thereby providing a very efficient pre-washing or preliminary treatment, and predisposing the article for the final washing in a kitchenware washing machine, or eventually for a simple rinsing action.

I claim:

1. A device for quickly cleaning, de-scaling, washing and polishing kitchenware, glasses and in particular pots and the like, which comprises a rotating brushing tool, a handle associated thereto, said brushing tool being shiftable to be presented in a variety of positions and orientations, an energy source which comprises an electric motor mechanically coupled to said brushing tool, by means of a flexible driving system; a switch effective to activate and deactivate said electric motor, said flexible driving system driving remotely said switch through an electroinsulating element, a box-supporting member effective to support and house said brushing tool, when said device is not in operation, and wherein said motor and said switch are enclosed.

2. A device according to claim 1, which comprises mechanical means for connecting said switch to said flexible driving system, whereby a pull force on said flexible driving system drives said motor and said brush and a pull force in the opposite direction stops the motor, said mechanical means including springing means.

* * * * *